US006290514B1

(12) United States Patent
McHugh et al.

(10) Patent No.: US 6,290,514 B1
(45) Date of Patent: Sep. 18, 2001

(54) LOW-INDUCTANCE LOW-RESISTANCE ELECTRICAL CONNECTOR

(75) Inventors: Robert G. McHugh, Evergreen, CO (US); William B. Walkup, Hillsboro, OR (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/549,155

(22) Filed: Apr. 13, 2000

(51) Int. Cl.[7] ..... H01R 13/648
(52) U.S. Cl. ..... 439/108; 439/593
(58) Field of Search ..... 439/660, 636, 439/637, 101, 108, 839, 592, 593

(56) References Cited

U.S. PATENT DOCUMENTS 4,834,677 * 5/1989 Archang ..... 439/593
5,160,275 * 11/1992 Nakamura et al. ..... 439/593
5,295,843 * 3/1994 Davis et al. ..... 439/637
6,024,587 * 2/2000 Garth ..... 439/101

* cited by examiner

*Primary Examiner*—Gary F. Paumen
(74) *Attorney, Agent, or Firm*—Wei Te Chung

(57) ABSTRACT

A low-inductance, low-resistance electrical connector for delivering power from a power supply to an IC module comprises a ground contact, a processor power contact and a cache power contact stamped from pure copper sheets and separated from each other by thin insulation film. Plastic members are provided with spring arms to engage with and thus provide sufficient normal force for contact arms of the corresponding contacts to engage with corresponding contact pads of the IC module thereby ensuring a reliable electrical connection. The ground contact and the processor and cache power contacts are connected with a capacitor board by pressure engagement to connect with the power supply. A number of individual signal contacts is also provided to interconnect a signal source with the IC module via a signal board.

1 Claim, 14 Drawing Sheets

LOW-INDUCTANCE LOW-RESISTANCE ELECTRICAL CONNECTOR

BACKGROUND OF THE INVENTION

1. Field of the Invention

The present invention relates to an electrical connector, and particularly to a low-inductance, low-resistance electrical connector for making a connection between a high speed, high power consuming integrated circuit module and its power supply.

2. Description of Prior Art

With the development of higher levels of integration in integrated circuits (ICs), power requirements have increased. This is particularly true for current microprocessor and associated integrated circuits or chips recently developed. These chips, which are operating at higher speeds, require and consume greater amounts of power than previously required.

A microprocessor and its associated IC devices, such as a cache, are typically mounted on a board or a module. Such an IC module plugs into an electrical connector on a motherboard that has power contacts in the form of pins retained therein to deliver power from a power supply to this IC module.

However, current microprocessors have been designed to consume a large amount of power and to operate at a low operating voltage, e.g., 3.1 volts, which means that the current supplied to the IC module has become particularly relatively high. It is expected that future microprocessors will operate at a voltage as low as 1 volt and will have a current demand up to 80 amps. As a result, it is necessary to establish a low-resistance, low-inductance path between the power supply and the IC module.

Since conventional connectors have power contacts generally having a small cross-sectional area, inductance effects, resistance losses, and temperature rise due to Joule heating are significant and result from the large resistance of the power contacts. Therefore, an electrical connector with improved power contacts is desirable to meet high current, low-inductance, low temperature rise requirements in power applications.

Furthermore, in conventional connectors, the power contacts are made of copper alloys such as C194 and C195 (Unified Numbering System designation being applied). These copper alloys are formed by adding other metals such as tin, beryllium, and nickel to copper, giving the resulting alloy improved strength and elasticity. However, these alloys have an electrical conductivity only 10 to 30 percent of that of pure copper. When there is a demand for high current carrying capacity, low-inductance, and low temperature rise depending on low-resistance, these copper alloys are no longer suitable. Therefore, a high conductivity material, such as pure copper, must be selected for the power contacts to optimize electrical performance so that the disadvantage of the conventional power contacts can be overcome. However, as pure copper is relatively weak in strength, a new and novel arrangement is required to provide the pure copper power contacts with sufficient contact normal force, which is necessary for making a reliable electrical connection with the IC module.

The present invention solves the above-mentioned problems by providing an electrical connector which has power transmitting contacts stamped from pure copper sheets and a mechanism providing these power contacts with sufficient normal force to engage with an IC module mating with the connector. This arrangement establishes a low-inductance, low-resistance power delivery path between a power supply and the IC module.

SUMMARY OF THE INVENTION

Accordingly, one object of the present invention is to provide a low-inductance, low-resistance electrical connector having power contacts made of a high conductivity material which are separated from each other by thin insulation films to deliver power from a power supply to an IC module.

Another object of the present invention is to provide a low-inductance, low-resistance electrical connector having plastic spring arms providing contact normal forces for pure copper power contacts to ensure a reliable electrical connection between the power contacts and corresponding contact pads of an IC module.

A further object of the present invention is to provide a low-inductance, low-resistance electrical connector that is connected to a power supply via a capacitor board connected with the connector by pressure engagement.

In order to achieve the objects set forth, a low-inductance, low-resistance electrical connector of the present invention for delivering power from a power supply to a high power consuming IC module comprises a ground contact, a processor power contact and a cache power contact stamped from pure copper sheets and separated from each other by a thin insulation film. Plastic members are provided with spring arms to engage with and thus provide sufficient normal force for contact arms of the corresponding contacts to ensure a reliable electrical connection with corresponding contact pads of the IC module. The ground contact and the processor and cache power contacts are connected to a capacitor board by pressure engagement, the capacitor board being also connected to the power supply. A plurality of individual signal contacts is also provided to interconnect a signal source with the IC module via a signal board.

According to one aspect of the present invention, the ground contact, the processor power contact and the cache power contact are made of a high conductivity material and are separated from each other by a thin insulation film to reduce resistance and inductance. Thus, the effects of the connector on the power delivery path from the power supply to the IC module is minimized.

According to another aspect of the present invention, each plastic member is provided with spring arms to engage with corresponding curved contact sections of the ground contact and the processor and cache power contacts. When the curved contact sections mate with corresponding contact pads on opposite sides of the mating edge of the IC module, the contact normal force necessary for a reliable electrical connection therebetween is provided by corresponding spring arms of the plastic members engaged with the curved contact sections.

According to a further aspect of the present invention, the capacitor board is connected with the ground contact and the processor and cache power contacts by pressure engagement achieved by engagement between alignment pegs and alignment holes.

Other objects, advantages and novel features of the invention will become more apparent from the following detailed description when taken in conjunction with the accompanying drawings.

DETAILED DESCRIPTION OF THE INVENTION

Figure 1:
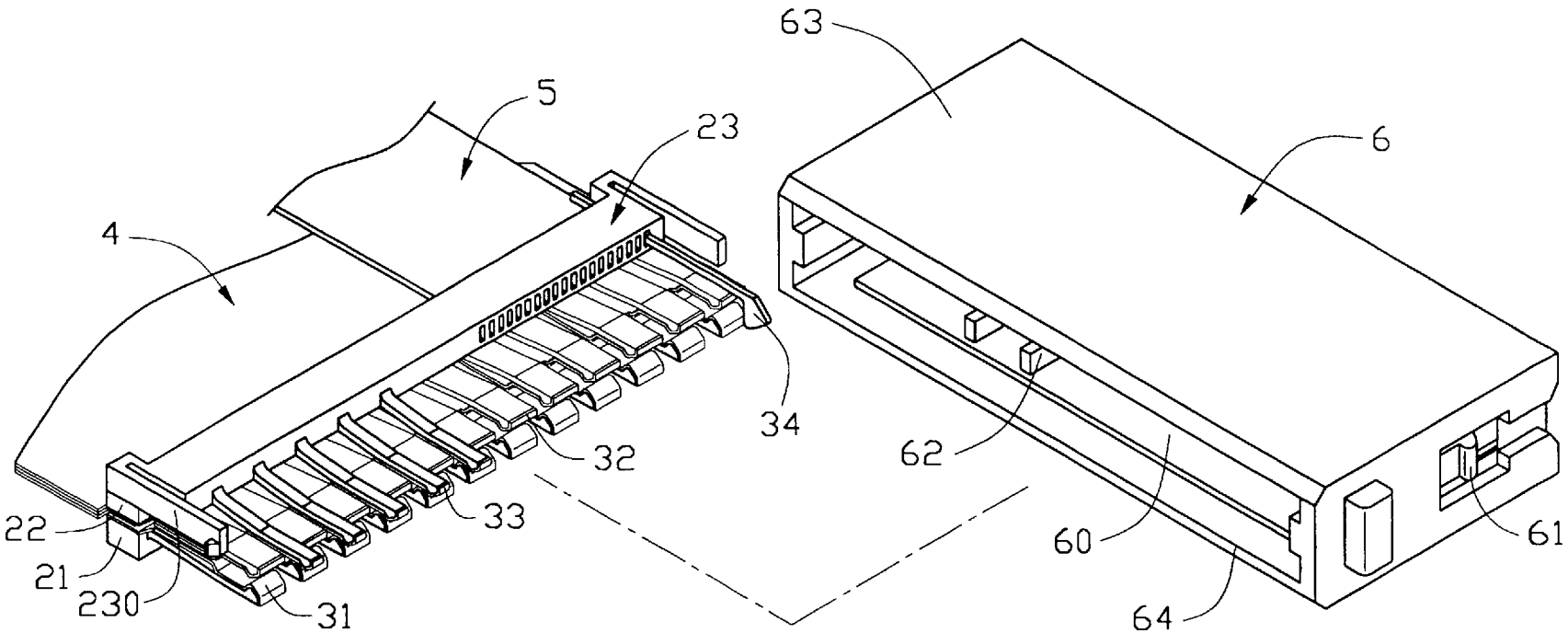
FIG. 1 is a partially exploded view of an electrical connector of the present invention with a capacitor board and a signal board connected.

Reference will now be made to the drawing figures to describe the present invention in detail.

Referring to FIG. 1, an electrical connector for delivering power and signals from a power supply (not shown) and a signal source (not shown) to an IC module (not shown) in accordance with the present invention comprises bottom, middle and top plastic members 21, 22 and 23 arranged in a stack. A plurality of contacts, including a ground contact 31, a processor power contact 32, a cache power contact 33 and a plurality of individual signal contacts 34, are engaged with corresponding plastic members 21, 22 and 23. A capacitor board 4 has a front end disposed between the bottom and middle plastic members 21 and 22, and a rear end for being connected to power and grounding lines of the power supply. A signal board 5, such as a flexible printed circuit board, has opposite front and rear ends respectively connected with the signal contacts 34 and the signal source via a signal connector (not shown). An insulative housing 6 defines a slot 60 for detachably receiving the plastic members 21, 22 and 23 and the contacts 31, 32, 33 and 34 therein by a snap engagement between opposite latches 230 of the top plastic member 23 and corresponding hooks 61 on opposite sides of the housing 6. To increase rigidity, the housing 6 is provided with ribs 62 connecting top and bottom walls 63 and 64 thereof. The housing 6 receives the IC module in the slot 60 at a front open end thereof to establish an electrical connection between the contacts 31, 32, 33 and 34 and the IC module which has high power consuming IC chips disposed thereon, such as a CPU (Central Processing Unit). Thus, power is delivered from the power supply to the high power consuming IC chips via the electrical connector of the present invention.

Figure 2:
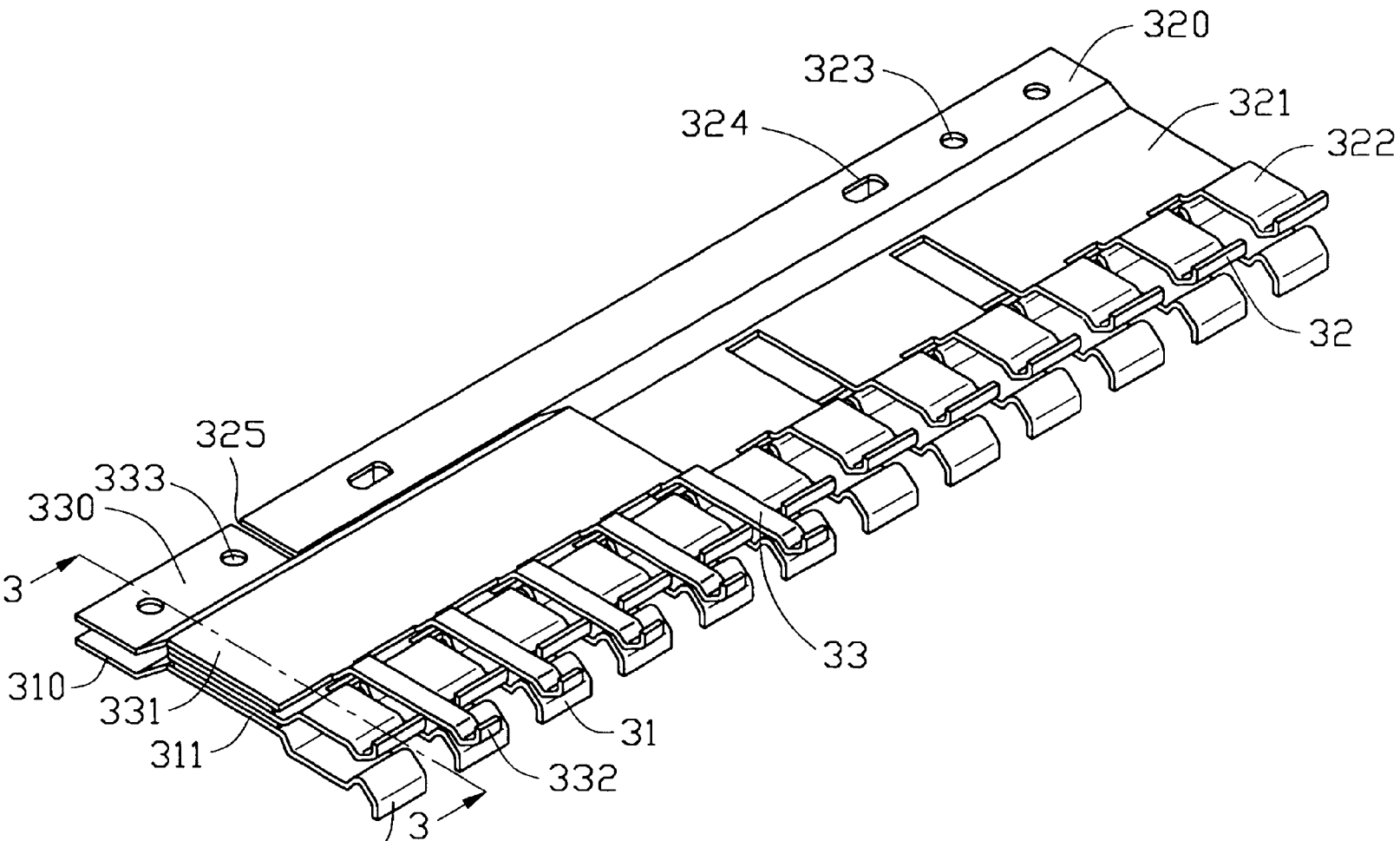
FIG. 2 is a perspective view showing assembled ground contacts, processor power contacts and cache power contacts of the present invention with insulation films disposed therebetween.
Figure 3:
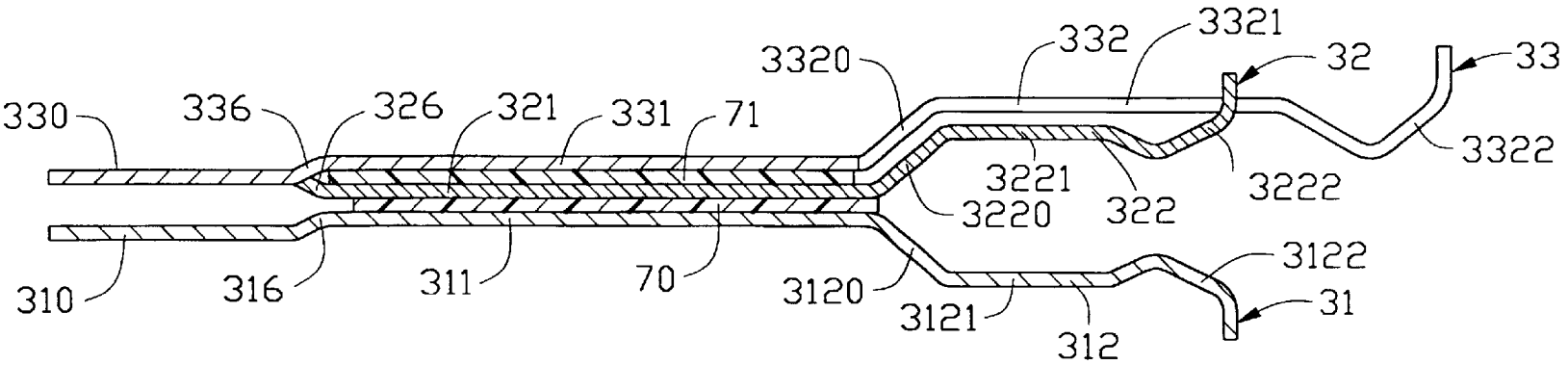
FIG. 3 is a cross-sectional view taken along line 3—3 of FIG. 2 illustrating the positional interrelation between the ground contacts, the processor power contacts and the cache power contacts.
Figure 5:
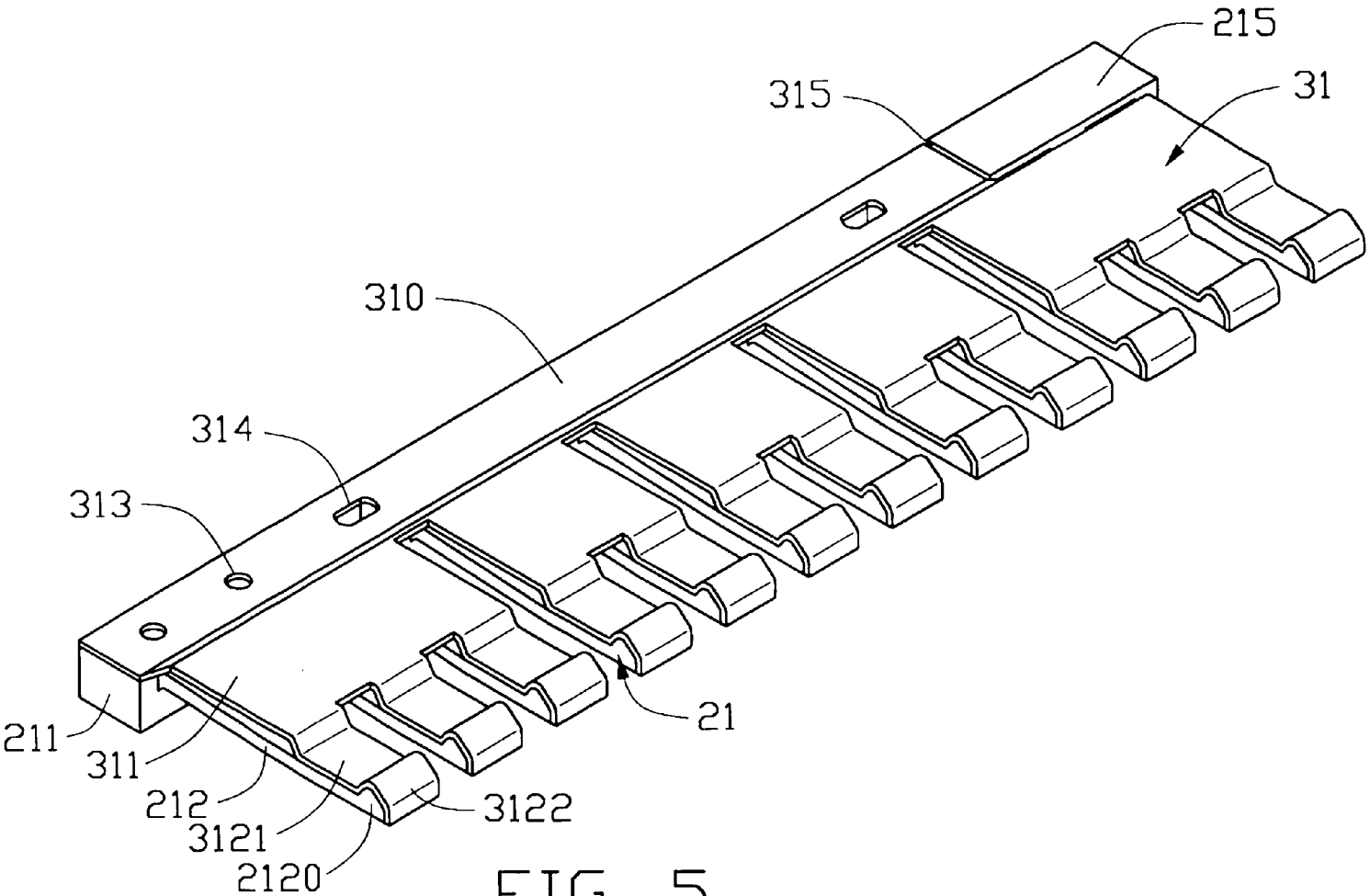
FIG. 5 is a perspective view showing a lower subassembly consisting of the bottom plastic member and the ground contact.

As shown in FIGS. 2, 3 and 5, each of the ground contact 31, the processor power contact 32 and the cache power contact 33 is stamped from a high conductivity metal sheet, thereby having a large conducting surface to reduce the bulk resistance. Each contact 31, 32, 33 respectively includes a rear end portion 310, 320, 330, a body portion 311, 321, 331 and a plurality of spring arms 312, 322, 332 forwardly extending from the body portion 311, 321, 331. The body portions 311, 321, 331 are parallel to each other. An inclined transient portion 316, 326, 336 respectively interconnects the body portion 311, 321, 331 with the rear end portion 310, 320, 330.

Each rear end portion 310 and 320 of the ground contact 31 and the processor power contact 32 is in the form of an elongate strip and defines a pair of small dimension alignment holes 313 and 323, a pair of large dimension alignment holes 314 and 324, and a cutout 315 and 325 distanced from the small dimension alignment hole 313 and 323. The rear end portion 330 of the cache power contact 33 also defines a pair of small dimension alignment holes 333 identical to the alignment holes 313 and 323.

Each spring arm 312, 322, 332 of the contact 31, 32, 33 includes an inclined section 3120, 3220, 3320 respectively extending from the body portion 311, 321, 331, a horizontal section 3121, 3221, 3321, and a curved contact section 3122, 3222, 3322 at a free end thereof. The inclined sections 3120 and 3220 of the ground contact 31 and the processor power contact 32 extend in a reversed direction relative to that of the respective inclined transient portions 316 and 326. The inclined section 3320 of each contact arm 332 of the cache power contact 33 extends in the same direction as that of the inclined transient portion 336. The contact sections 3222 and 3322 of the respective contacts 32 and 33 have lowest contacting points lying in the same plane for contacting corresponding contact pads on an upper side of the IC module, as clearly shown in FIG. 3. Each contact section 3122, 3222, 3322 has minimally convex curvatures and a large width, which allows for a springy coupling with corresponding contact pads along opposite sides of a mating edge of the IC module and further lowers the resistance and inductance on the power delivery path.

Preferably, in this embodiment, the contacts 31, 32 and 33 are made from pure copper, such as C110, which is commercially available pure copper with a minimum conductivity of 101 percent IACS (International Annealed Copper Standard). The adoption of pure copper results in a significantly increased electrical conductivity of the contacts 31, 32 and 33 compared to conventional copper alloy power pins and also a high thermal conductivity. Furthermore, the usage of pure copper also significantly reduces the bulk resistance of the contacts 31, 32 and 33 since resistance varies linearly with the conductivity.

The body portions 311 and 321 of the ground contact 31 and the processor power contact 32 are divided into several sections. The ground contact 31 and the processor power contact 32 are arranged in such a manner that the cutouts 315 and 325 thereof are located at opposite ends and the large dimension alignment holes 314 and 324 thereof are aligned with each other. As is clearly shown in FIG. 3, the parallel body portions 311 and 321 of the respective ground contact 31 and the processor power contact 32 are separated by a thin insulation film 70. The thickness of the insulation film 70 is selected to reduce inductance effects and to keep the electrical potentials of the opposing contacts 31 and 32 in close physical proximity to one another. The spring arms 312 and 322 are arranged in a symmetrical manner relative to the plane containing the insulation film 70 to respectively mate with corresponding ground pads and processor power pads on opposite sides of the IC module.

The body portion 331 of the cache power contact 33 overlaps a portion of and is also separated from the body portion 321 of the processor power contact 32 by a selected thin insulation film 71. The thin insulation film 71 reduces inductance effects and keeps the electrical potentials of the opposing contacts 32 and 33 in as close physical proximity to one another as possible. The rear end portion 330 of the cache power contact 33 is fit into the cutout 325 of the processor power contact 32 with the alignment holes 333 thereof aligned with corresponding alignment holes 313 of the ground contact 31. The rear end portions 330 and 320 of the respective cache power contact 33 and the processor power contact 32 are substantially located in the same plane. Each spring arm 332 of the cache power contact 33 extends above and is located between adjacent spring arms 322 of the processor power contact 32. The spring arms 332 forwardly project a larger distance than that of the spring arms 312 and 322 to mate with corresponding cache power pads of the IC module located forward of the processor power pads.

Figure 4:
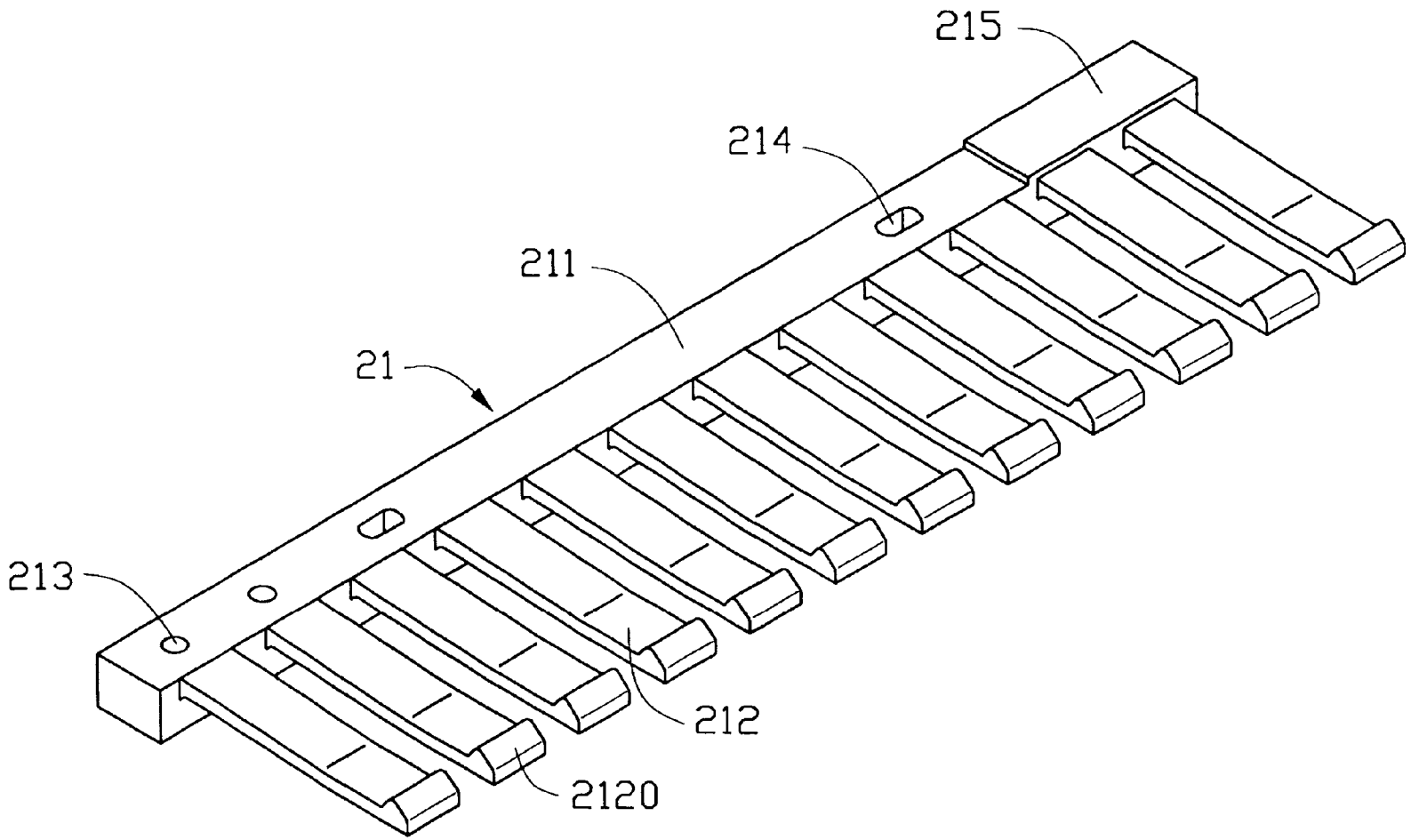
FIG. 4 is a perspective view of a bottom plastic member of the present invention.

FIG. 4 shows a perspective view of the bottom plastic member 21 of the present invention, and FIG. 5 illustrates a lower subassembly consisting of the bottom plastic member 21 and the ground contact 31. The bottom plastic member 21 includes an elongate body 211 and a plurality of spring arms 212 forwardly extending from the elongate body 211 corresponding to the spring arms 312 of the ground contact 31. The elongate body 211 defines a pair of small dimension alignment holes 213 to align with corresponding alignment holes 313 of the ground contact 31, and a pair of large dimension alignment holes 214 to align with corresponding alignment holes 314 of the ground contact 31. A raised section 215 is formed at one end of the body 211 to compensate for the cutout 315 of the ground contact 31 and has a height substantially equal to the thickness of the rear end portion 310 of the ground contact 31. Each spring arm 212 has an enlarged section 2120 to engage with the corresponding curved contact section 3122 of the ground contact 31 whereby the horizontal section 3121 of the ground contact 31 rests on the spring arm 212.

Figure 6:
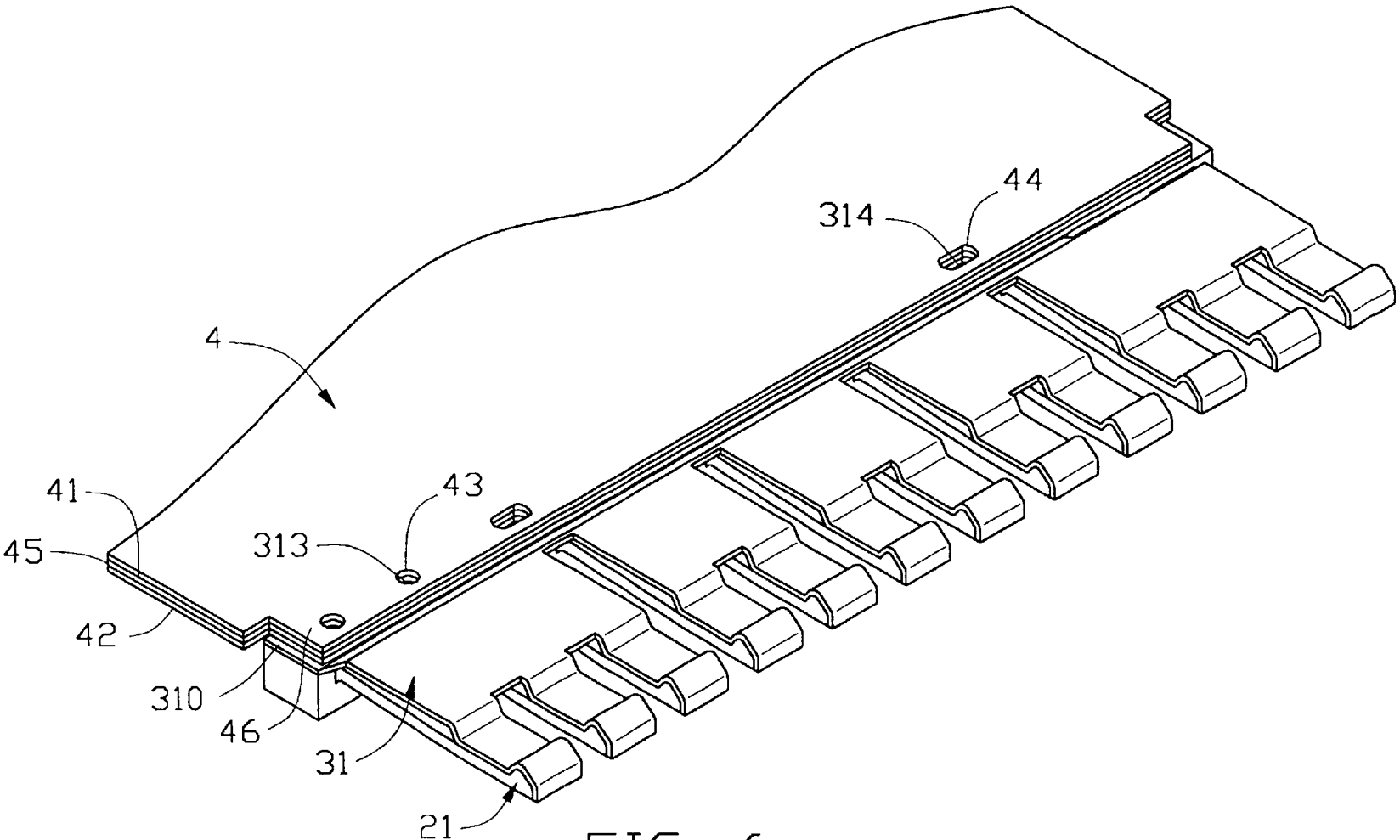
FIG. 6 is a perspective view showing a capacitor board being disposed on the lower subassembly of FIG. 5.

FIG. 6 illustrates the capacitor board 4 being disposed on the lower subassembly shown in FIG. 5. The capacitor board 4 is a lamination consisting of top and bottom conductive layers 41 and 42 and an insulation film 45 between the two conductive layers 41 and 42 to form a substantial capacitor for storing electric charge. The capacitor board 4 has a front mating end 46 lying on the rear end portion 310 of the ground contact 31. The front mating end 46 also defines two small dimension alignment holes 43 and two large dimension alignment holes 44 respectively aligned with the alignment holes 313, 213 and 314, 214 of the ground contact 31 and the bottom plastic member 21.

Figure 7:
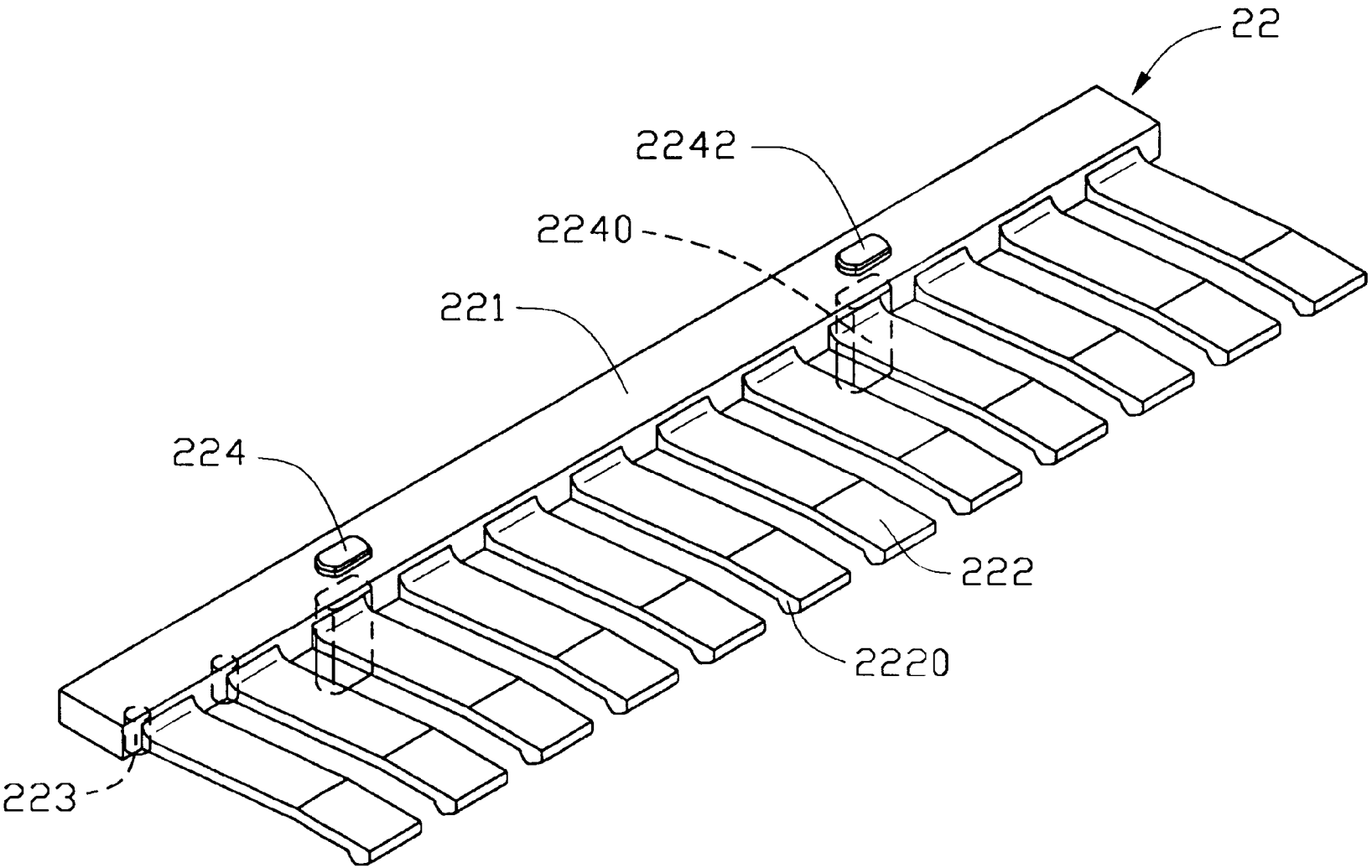
FIG. 7 is a perspective view of a middle plastic member of the present invention.

The middle plastic member 22 of the present invention is shown in FIG. 7. The middle plastic member 22 includes an elongate body 221 and a plurality of plastic spring reinforcement arms 222 forwardly extending from the body 221. A pair of downwardly extending small dimension alignment pegs 223 and a pair of large dimension alignment pegs 224 are provided on the body 221. Each alignment peg 224 comprises a downwardly projecting lower protrusion 2240 and an upwardly projecting upper protrusion 2242. The number of the spring arms 222 corresponds to that of the spring arms 322 of the processor power contact 32 and each spring arm 222 has an enlarged section 2220 at a free end thereof.

Figure 8:
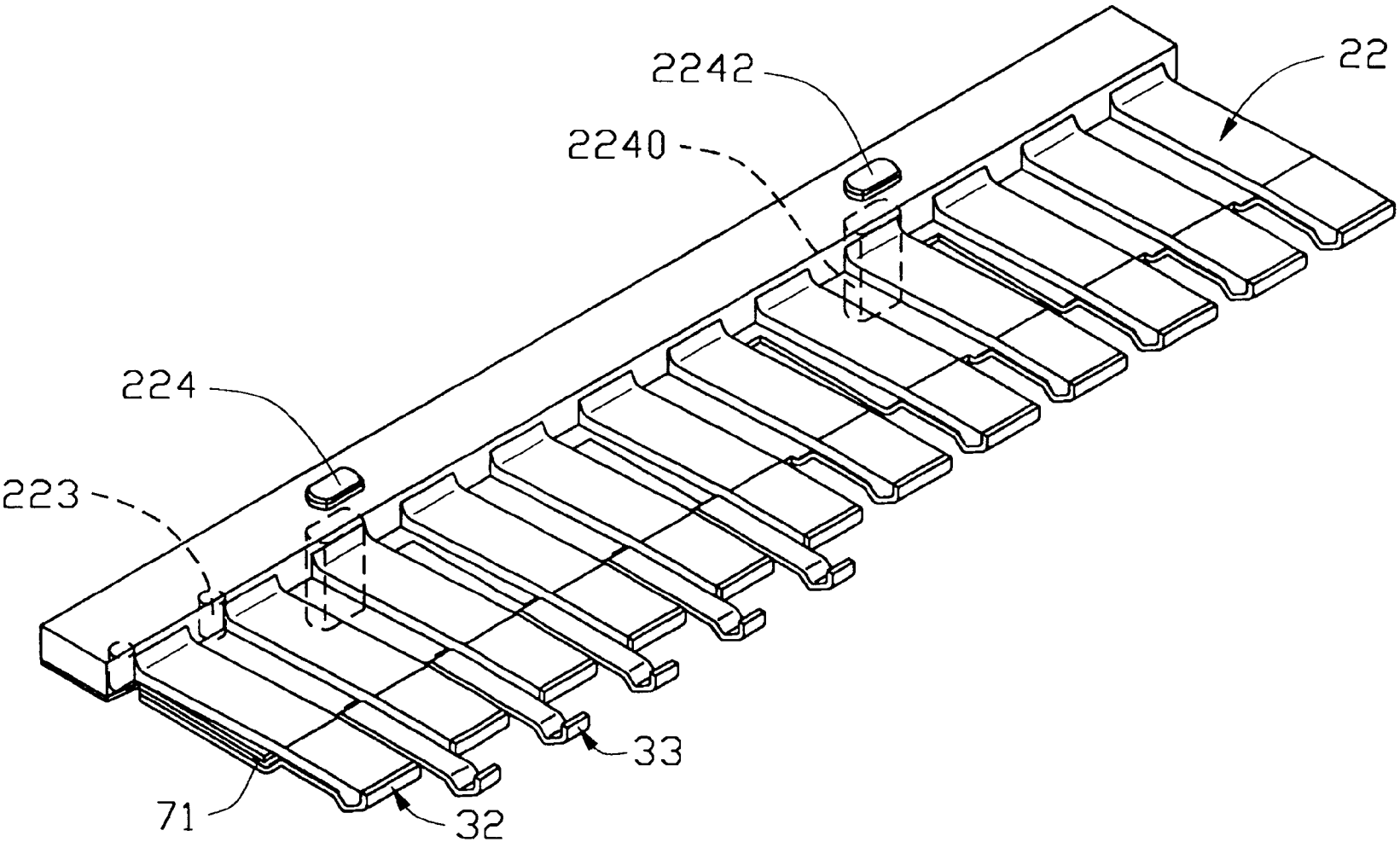
FIG. 8 is a perspective view of a middle subassembly consisting of the middle plastic member, the cache power contact and the processor power contact.
Figure 9:
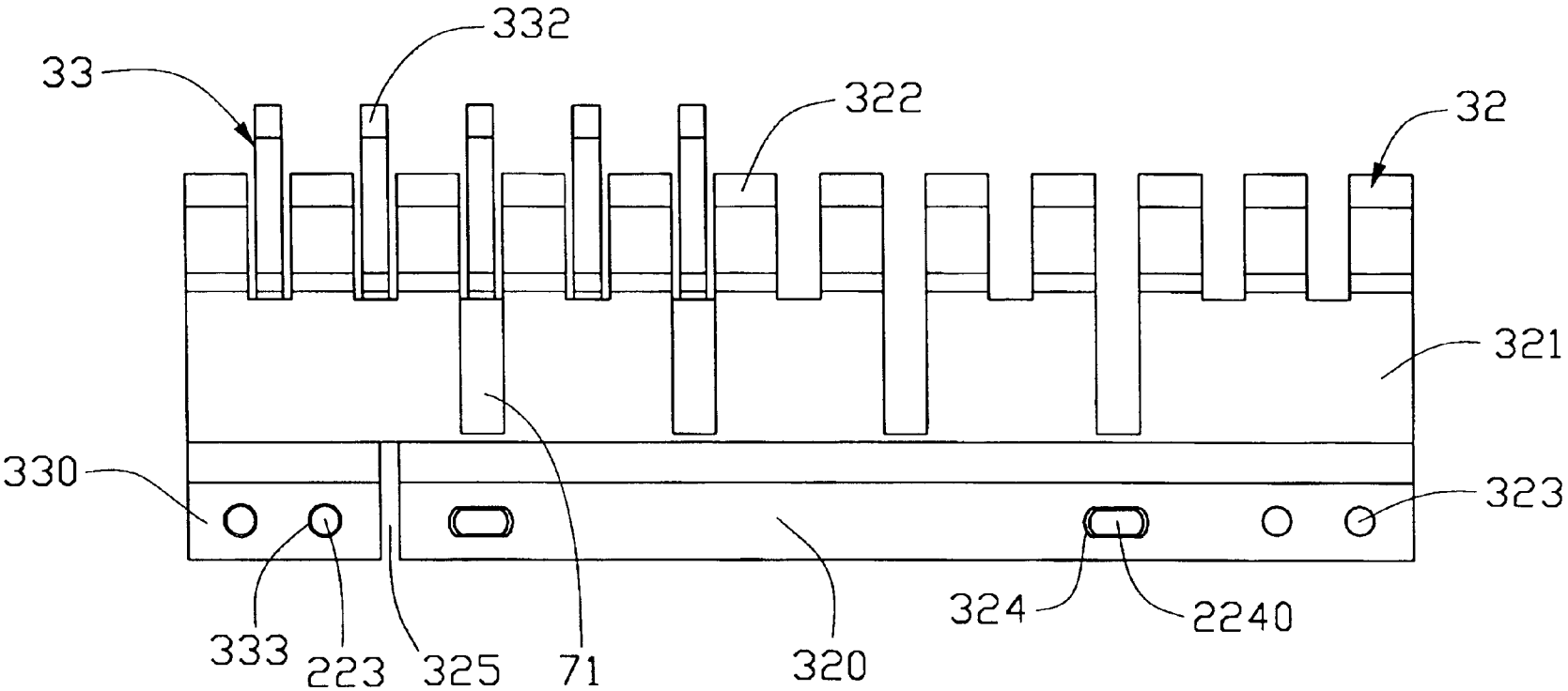
FIG. 9 is a bottom plan view of FIG. 8.

A middle subassembly consisting of the processor power contact 32, the cache power contact 33 and the middle plastic member 22 is shown in FIGS. 8 and 9. In assembly, the cache power contact 33 is superposed on the processor power contact 32 with the rear end portion 330 of the cache power contact 33 fitting in the cutout 325 and the insulation film 71 being sandwiched between the body portions 331 and 321. Each spring arm 332 of the cache power contact 33 extends above and is located between adjacent spring arms 322 of the processor power contact 32, and further extends a larger distance in front of the middle subassembly than the spring arms 322. The alignment pegs 223 of the middle plastic member 22 then extend through the alignment holes 333, and simultaneously, the lower protrusions 2240 of the alignment pegs 224 extend through the alignment holes 324, thereby forming a middle subassembly.

Figure 10:
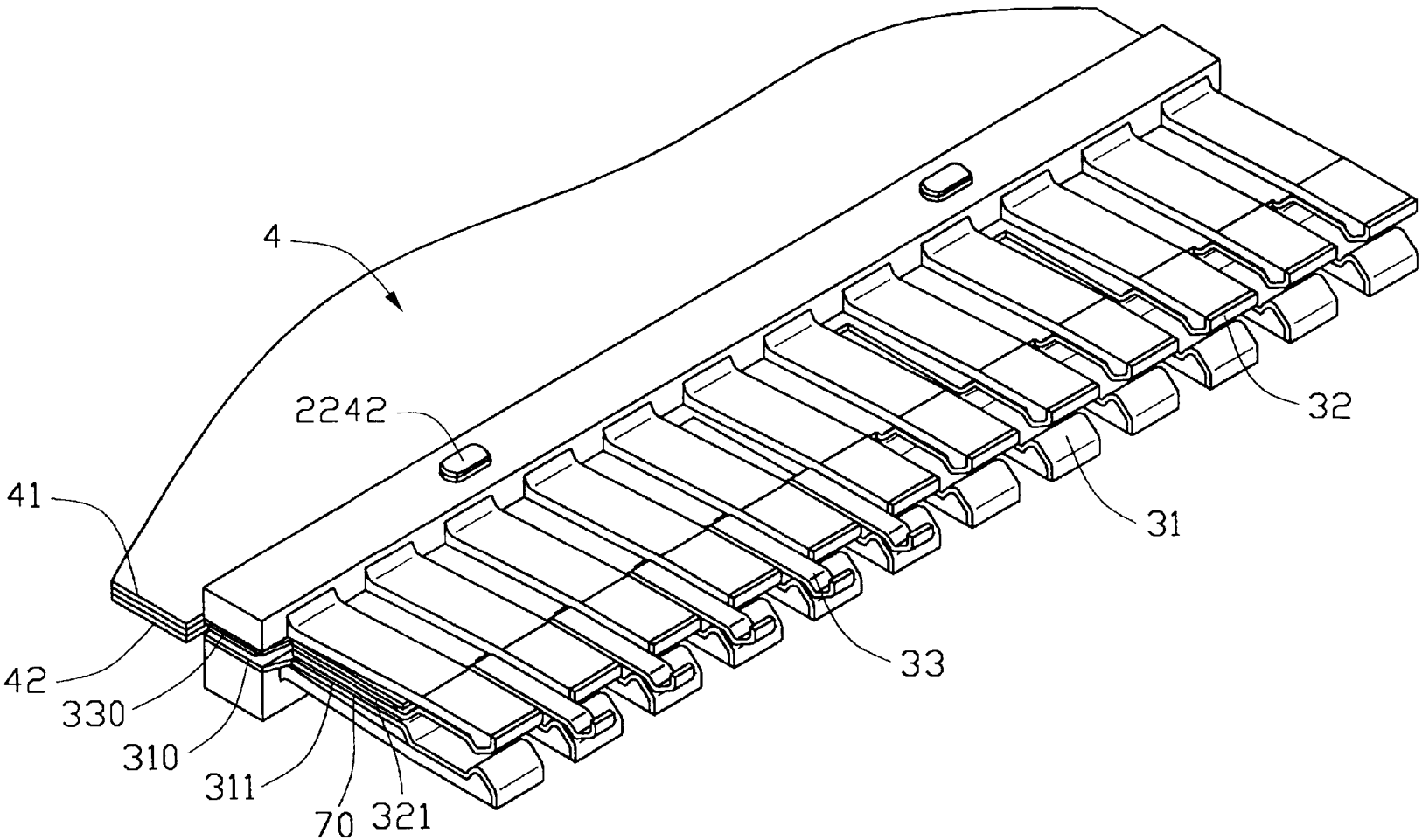
FIG. 10 is an assembled view of the lower subassembly shown in FIG. 5 and the middle subassembly shown in FIG. 8 with the capacitor board and an insulation film sandwiched therebetween.

Referring to FIG. 10, the middle subassembly is then positioned on the lower subassembly shown in FIG. 5 with the front mating end 46 of the capacitor board 4 disposed between the rear end portions 310, 320 and 330 of the contacts 31, 32 and 33. The body portions 311 and 321 of the contacts 31 and 32 are separated by the insulation film 70. Also referring to FIGS. 6 and 8, the alignment pegs 223 of the middle plastic member 22 sequentially extend through the aligned alignment holes 43, 313 and 213 (not visible), and simultaneously, the alignment pegs 224 extend through the aligned holes 44, 314 and 214. Thus, the lower subassembly and the middle subassembly are secured to each other with the capacitor board 4 disposed therebetween whereby the rear end portions 310 and 320, 330 of the contacts 31 and 32, 33 are respectively in electrical connection with the bottom and top conductive layers 42 and 41 of the capacitor board 4.

Figure 11:
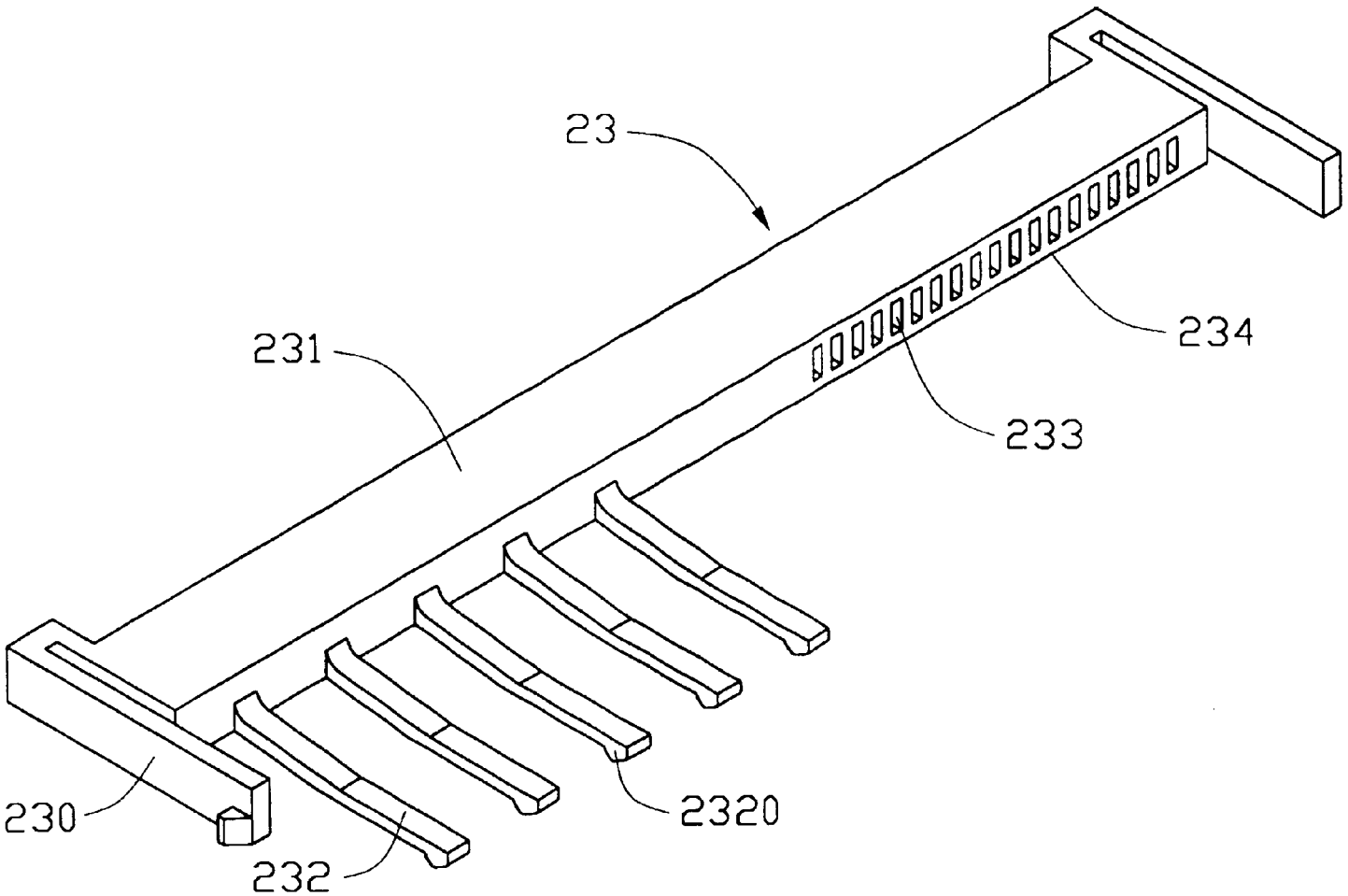
FIG. 11 is a perspective view of a top plastic member of the present invention.

The top plastic member 23 of the present invention is shown in FIG. 11. The top plastic member 23 comprises an elongate body 231 similar to the bodies 211 and 221, a pair of latches 230 provided on opposite ends of the body 231, a plurality of spring reinforcement arms 232 extending from a left section of the body 231, and a plurality of passageways 233 defined in a right section of the body 231. The top plastic member 23 further defines a pair of engaging holes (not shown) in a bottom surface 234 thereof corresponding to the upper protrusions 2242 of the middle plastic member 22. Each spring arm 232 has an enlarged section 2320 at a free end thereof.

Figure 12:
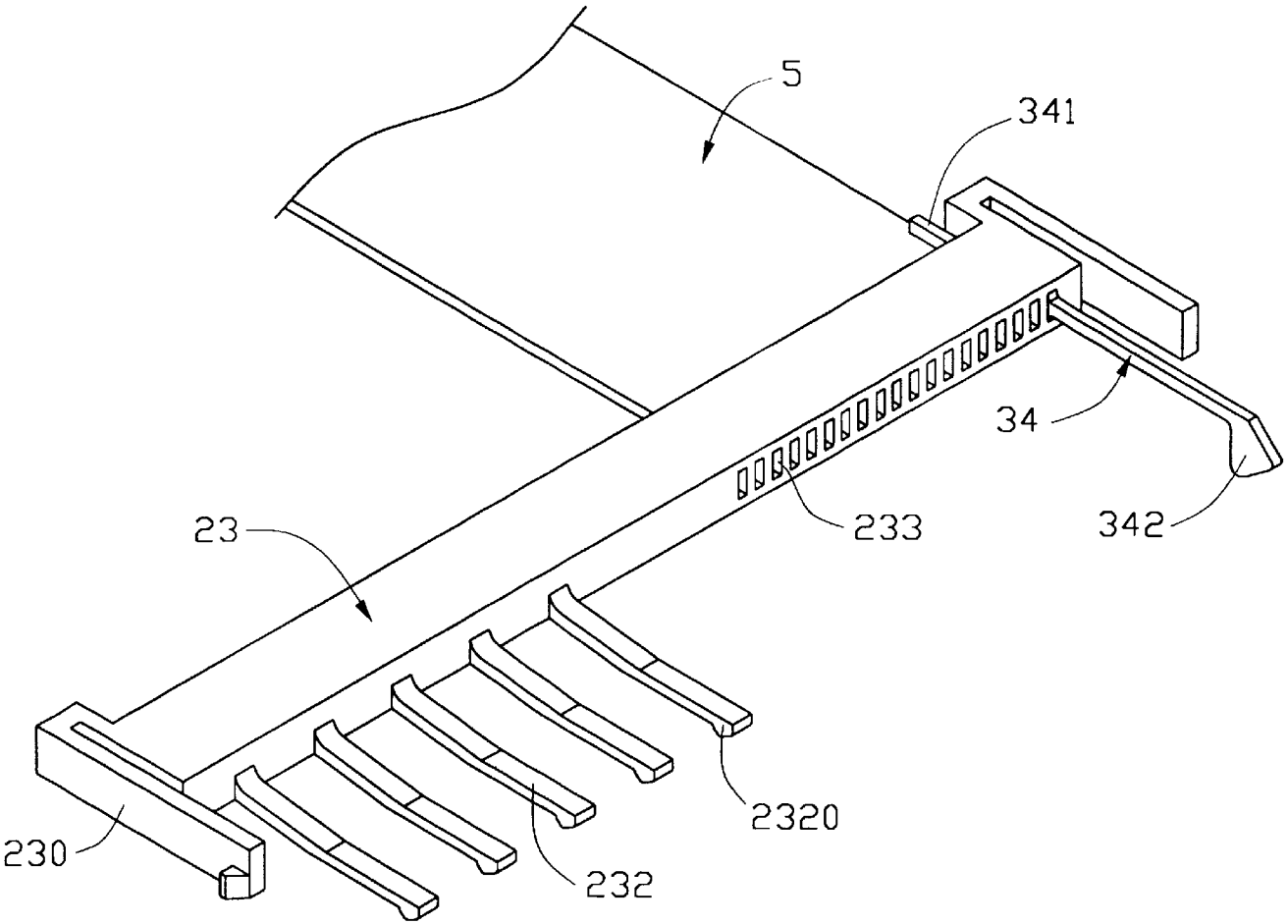
FIG. 12 is a perspective view showing the top plastic member having one signal contact received therein and terminated to a signal board.

FIG. 12 shows a perspective view of an upper subassembly of the present invention consisting of the top plastic member 23, the individual metal signal contacts 34 (only one being shown) and the signal board 5. The signal contacts 34 are in the form of individual contact pins and are retained in the passageways 233 of the top plastic member 23. Each signal contact 34 has a large cross section contact section 342 and a tail section 341 extending rearward through the passageway 233 to be soldered to a corresponding conductor of the signal board 5. The contact section 342 is adapted to mate with a corresponding signal pad of the IC module.

Figure 13:
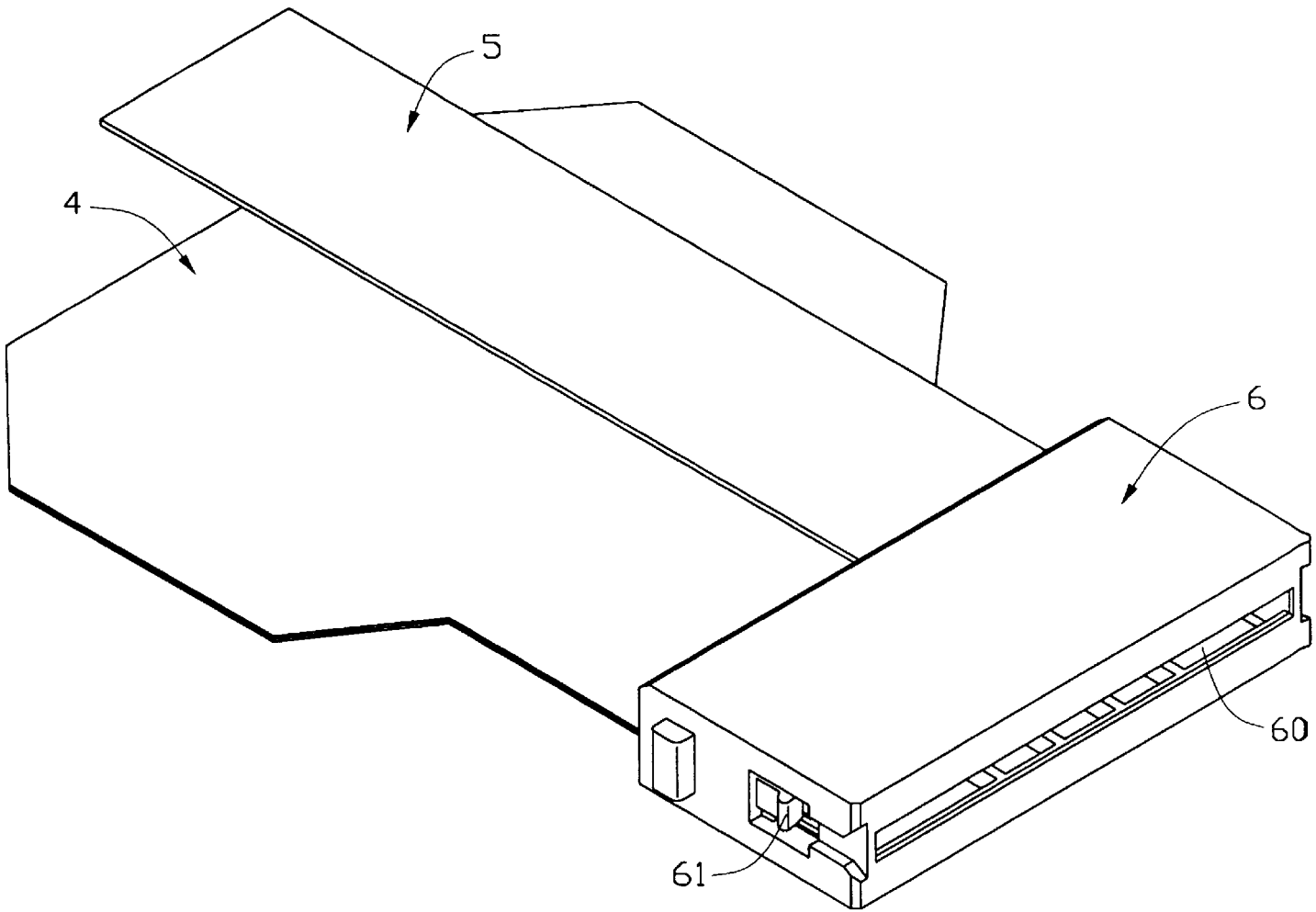
FIG. 13 is an assembled view of FIG. 1.
Figure 14:
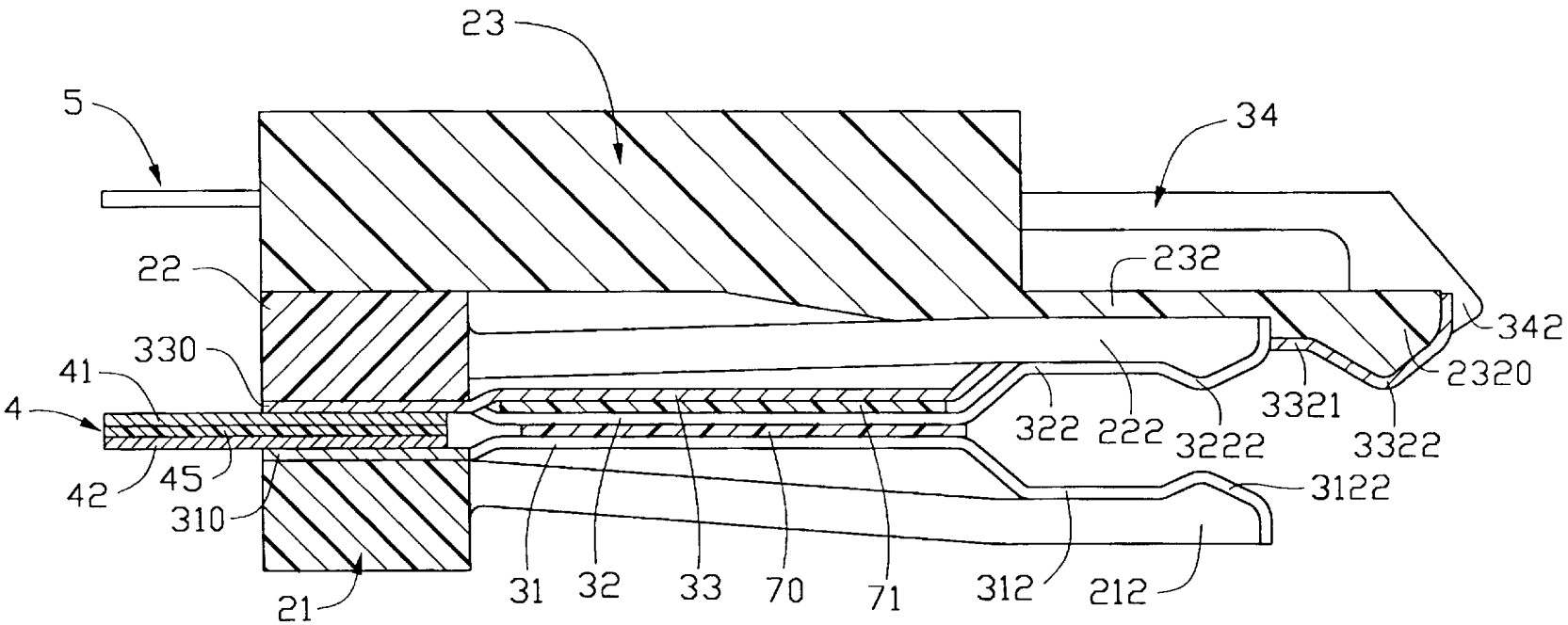
FIG. 14 is a cross-sectional view showing the engagement and positional interrelations between the plastic members, the contacts and associated signal and capacitor boards.

The upper subassembly is finally superposed on the stacked lower and middle subassemblies of FIG. 10 whereby the engaging holes of the top plastic member 23 are engaged with the upper protrusions 2242 of the middle plastic member 22 and the enlarged sections 2320 of the spring arms 232 are engaged with the curved contact sections 3322 of the spring arms 332 of the cache power contact 33, as is illustrated in FIG. 14. Referring back to FIG. 1, the stacked upper, middle and lower subassemblies are then inserted into the slot 60 of the housing 6 from the rear end of the housing 6 with the latches 230 of the top plastic member 23 engaging with the hooks 61 of the housing 6. The capacitor board 4 and the signal board 5 are exposed to the exterior of the housing 6 to be respectively coupled to the power supply and the signal source. A shield may enclose the capacitor board 4 and the signal board 5 to provide EMI/RFI shielding. Similarly, the housing 6 may further comprise a shield. Thus, an electrical connector of the present invention is obtained, as is shown in FIG. 13.

FIG. 14 is a cross-sectional view illustrating the engagement and positional interrelations between the contacts 31, 32, 33 and 34, the plastic members 21, 22 and 23, and the associated capacitor board 4 and signal board 5. The ground contact 31 and the processor power contact 32 are arranged in a substantial symmetrical manner relative to the plane containing the insulation film 70. The cache power contact 33 is mostly disposed above the processor power contact 32 except that the rear end portion 330 thereof is level with the rear end portion 320 of the processor power contact 32. Both the rear end portions 320 and 330 contact the top conductive layer 41 of the capacitor board 4, and the rear end portion 310 of the ground power contact 31 contacts the bottom conductive layer 42 of the capacitor board 4. Both of the signal contacts 34 and the spring arms 332 of the cache power contact 33 extend a longer distance in a forward direction than do the spring arms 312 and 322 of the ground contact 31 and the processor power contact 32. The spring contact section 342 of each signal contact 34 also has a lowest contacting point (not labeled) lying in the same plane with those of the contact sections 3322 and 3222 of the contacts 33 and 32.

When a mating edge of the IC module is inserted into the slot 60 of the housing 6 from the front end, the spring contact sections 342, 3322, 3222 and 3122 of the contacts 34, 33, 32 and 31 will be biased to connect with corresponding signal pads, cache power pads, and processor power pads on an upper side of the IC module, and with ground pads on a lower side of the IC module, respectively. In this process, the contact normal force, which is necessary for making a reliable electrical connection between the contact sections 3122, 3222, 3322 and the corresponding pads, is respectively provided by the engaged spring arms 212, 222 and 232 of the bottom, middle and top plastic members 21, 22 and 23. In this embodiment, the spring arms 212, 222 and 232 are preferably reinforced with fiber glass. This is a unique feature of the electrical connector of the present invention, i.e., the normal force is independent of the current carrying contacts 31, 32 and 33 stamped from pure copper sheets. In addition, the high contact normal force provided by the spring arms 212, 222 and 232 ensures large contact areas between the contact sections 3122, 3222 and 3322 of the contacts 31, 32 and 33 and the corresponding contact pads of the IC module. This minimizes and stabilizes the separable interface resistance between the contact sections 3122, 3222 and 3322 and the corresponding pads. Furthermore, the arrangement of the spring arms 312, 322 and 332 allows for a lack of uniform thickness or for bowing in the IC module. The metal signal contacts 34 are different from the spring arms 312, 322 and 332 of the contacts 31, 32 and 33 in that they individually provide the contact normal force generation to their large cross section contact sections 342.

A second unique feature of the present invention is that a low-resistance, low-inductance current path is established between the power supply and the IC module via the electrical connector. This feature is achieved by using the large surface area contacts 31, 32 and 33 stamped from high conductivity pure copper sheets and the thin insulation films 70 and 71 positioned between opposing parallel contacts 31, 32 and 33. The minimized resistance reduces Joule heating, thereby minimizing temperature rise and maximizing the current carrying capacity of the connector. Resistance losses, i.e., contact millivolt drops, are also minimized. By such an arrangement, the electrical connector of the present invention substantially becomes a capacitor with contacts, which makes it suitable for high current or power distribution applications.

A third feature of the present invention is that the capacitor board 4 is connected to the ground contact 31, the processor power contact 32 and the cache power contact 33 via pressure engagement, which is more timesaving and convenient compared to conventional soldering.

Although four types of contacts 31, 32, 33 and 34 are incorporated in the electrical connector of the present invention, it should be understood that the electrical connector may only contain two types of contacts, such as the contacts 31 and 32, whereby alignment pegs will be formed on the plastic member 22 to engage with alignment holes which will be defined in the bottom plastic member 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for delivering power from a power supply to an integrated circuit module having contact pads disposed along opposite sides of a mating edge thereof, comprising:

a first contact having a first rear end portion for connecting with grounding lines of the power supply and a first front end portion for mating with corresponding grounding pads on one side of the module;

a second contact insulated from the first contact, said second contact having a second rear end portion for connecting with power lines of the power supply and a second front end portion for mating with corresponding power pads on the other side of the module; and means for providing sufficient normal force for the first and second front end portions of the contacts to ensure a reliable electrical connection with the corresponding pads of the module upon insertion of the mating edge of the module between the first and second contacts;

wherein said first and second contacts are stamped from pure copper sheets;

wherein said means for providing sufficient normal force comprises a first plastic member positioned beneath the first contact and a second plastic member positioned on the second contact, said first and second plastic members respectively engaged with and thus providing sufficient normal force for the first and second front end portions of the first and second contacts;

wherein said front end portion of each contact comprises a plurality of contact arms, and each of said first and second plastic members comprises a plurality of spring arms engaged with corresponding contact arms of the respective first and second contacts;

wherein each contact arm of the first and second contacts has a curved contact section for mating with the corresponding pad of the module, and each spring arm of the first and second plastic members has an enlarged section engaging with the curved contact section of the corresponding contact arm of the respective first and second contacts;

further comprising an insulative housing receiving the first and second contacts and the means for providing sufficient normal force therein, said housing defining a slot for receiving the mating edge of the module therein to mate with the front end portions of the first and second contacts;

further comprising a third contact substantially positioned on and insulated from the second contact, said third contact having a third rear end portion for connecting with second power lines of the power supply and a third front end portion for mating with corresponding second power pads of the module;

wherein said third contact is stamped from a pure copper sheet;

wherein said second rear end portion of the second contact defines a cutout, and said third rear end portion of the third contact is fit into the cutout and is level with the second rear end portion of the second contact with the third front end portion located above the second front end portion of the second contact;

further comprising second means for providing sufficient normal force for the third front end portion of the third contact to ensure a reliable electrical connection with corresponding second power pads of the module.

* * * * *